United States Patent [19]

McCormick

[11] Patent Number: 4,871,334

[45] Date of Patent: Oct. 3, 1989

[54] MARINE PROPULSION DEVICE WITH IMPROVED EXHAUST DISCHARGE

[75] Inventor: Daniel F. McCormick, Oshkosh, Wis.

[73] Assignee: Brunswick Corporation, Skokie, Ill.

[21] Appl. No.: 228,322

[22] Filed: Aug. 4, 1988

[51] Int. Cl.[4] ..... B63H 21/32

[52] U.S. Cl. ..... 440/89; 416/93 A

[58] Field of Search ..... 440/89, 81, 80, 75, 440/77, 66, 79; 416/93 R, 93 A, 129 R, 129 A

[56] References Cited

U.S. PATENT DOCUMENTS

| | | | |
|---|---|---|---|
| 1,073,920 | 9/1913 | Miller | 440/89 X |
| 2,989,022 | 6/1961 | Lundquist | 416/129 A |
| 3,368,420 | 2/1968 | Alexander, Jr. | 440/75 X |
| 3,434,447 | 3/1969 | Christensen et al. | 440/89 X |
| 3,745,964 | 7/1973 | Henrich | 440/89 X |
| 4,645,463 | 2/1987 | Arneson | 440/57 |

*Primary Examiner*—Sherman D. Basinger

*Attorney, Agent, or Firm*—Andrus, Sceales, Starke & Sawall

[57] ABSTRACT

A marine propulsion device (1) includes a drive housing (6) to which is attached a suitable engine (4), the exhaust of which is pumped downwardly through a suitable passage (20) in the drive housing to adjacent a torpedo housing (7) carrying at least one propeller (9,10). A generally horizontal antiventilation plate (8) is disposed above the torpedo housing, and a strut (22) extends between the plate and the torpedo housing, just forwardly of the upper portion of the propeller. Substantially all of the engine exhaust is forced by the engine from the drive housing passage for discharge into the path of the upper portion of the propeller. In one embodiment, substantially all of the exhaust passes through the strut and is discharged rearwardly therefrom into ventilating engagement with the forward face of the propeller. In another embodiment, a portion of the exhaust (31) is also discharged downwardly through the antiventilation plate onto the upper edge portion of the propeller.

8 Claims, 2 Drawing Sheets

FIG. 1
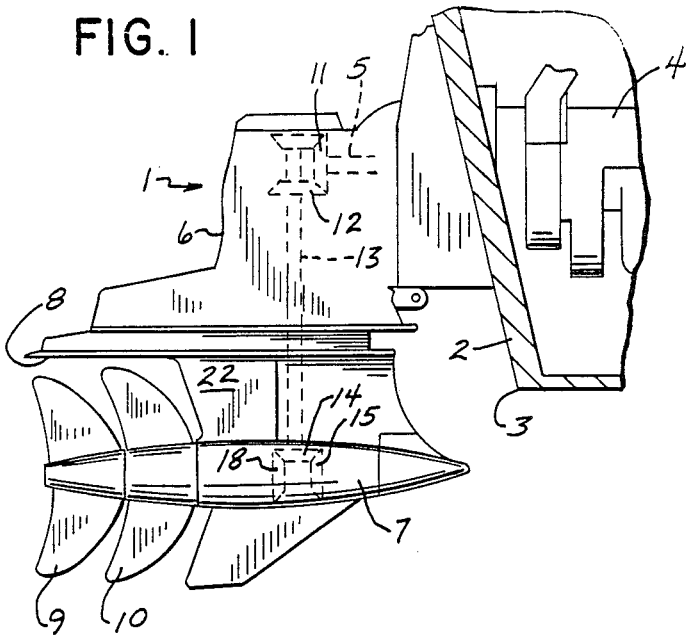
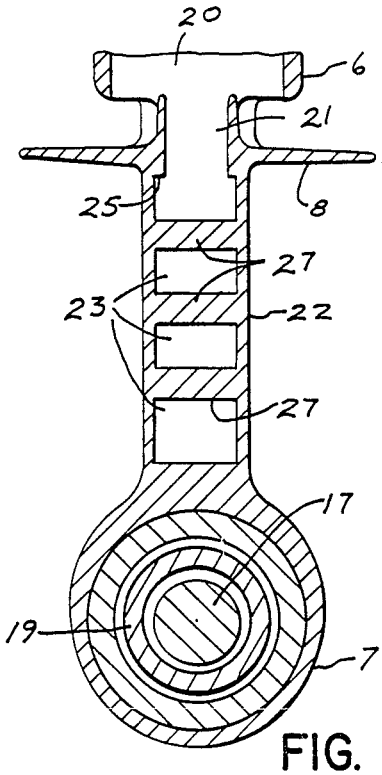
FIG. 3
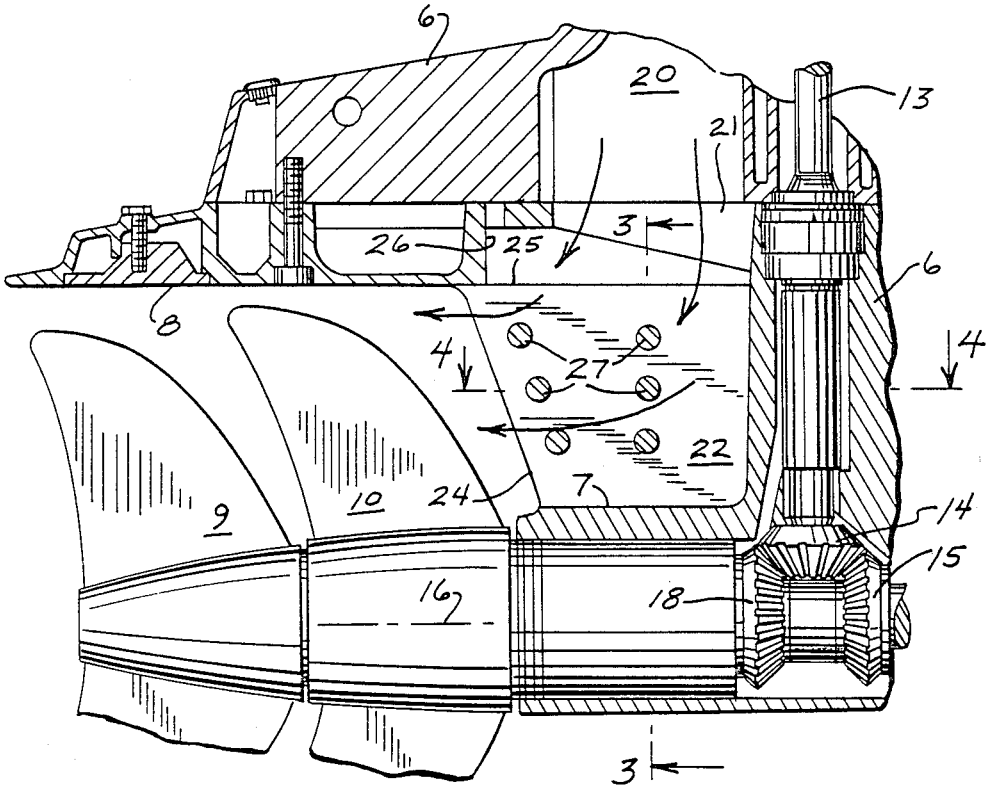
FIG. 2

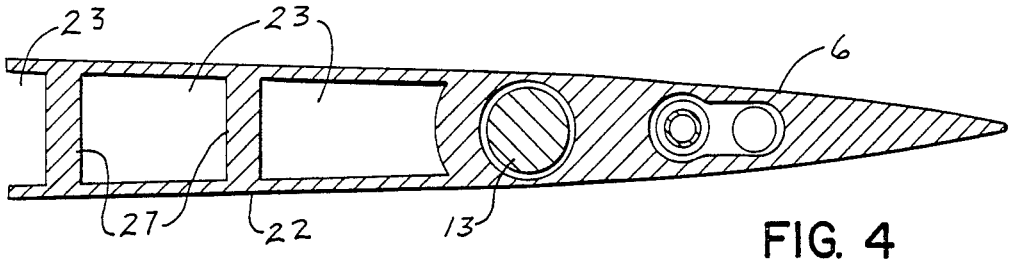
FIG. 4
FIG. 5
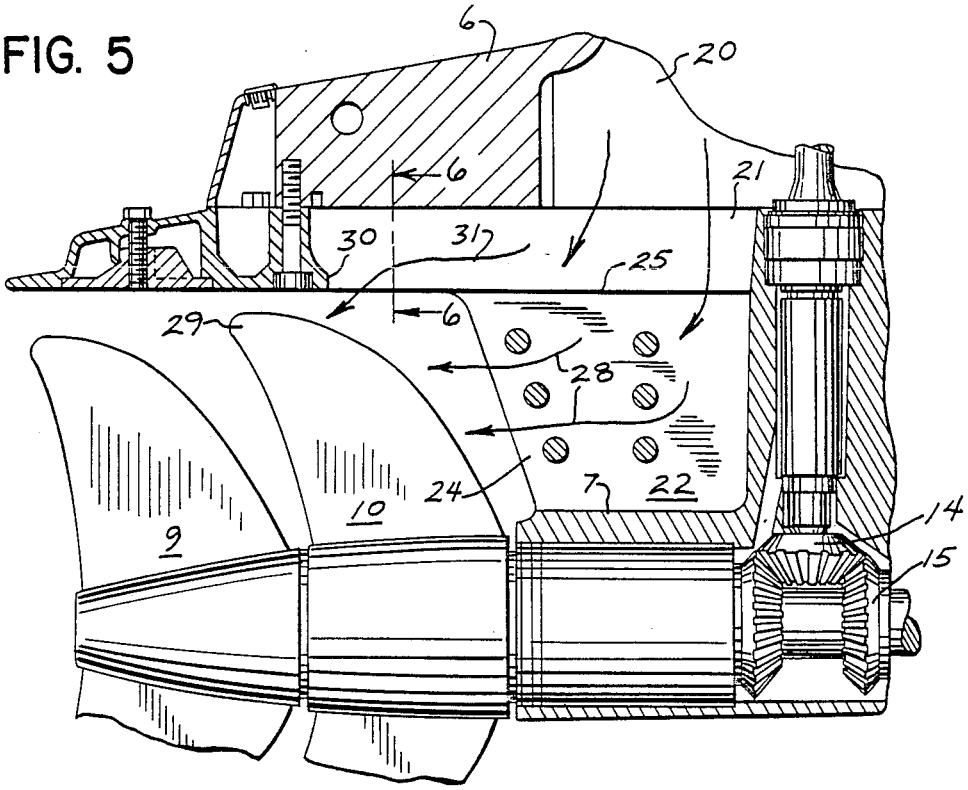
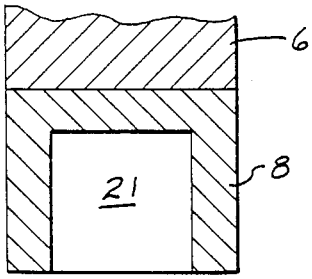
FIG. 6

MARINE PROPULSION DEVICE WITH IMPROVED EXHAUST DISCHARGE

BACKGROUND AND SUMMARY OF THE INVENTION

This invention relates to a marine propulsion device with an improved exhaust discharge.

In marine propulsion devices such as outboard motors, stern drives and the like, it has been found that there is too much propeller area for the horsepower of the engine under certain operating conditions. One of the results is to reduce acceleration. It has previously been suggested that a large portion of the engine exhaust gases be discharged above the propeller, while the remaining small portion of the gases be discharged into the path of the upper part of the propeller to "desolidify" the water adjacent the propeller to thus, in effect, reduce the propeller area. See U.S. Pat. No. 3,745,964. In that patent, the small portion of the exhaust is entrained into the propeller by suction caused by the water passing around the gear case strut.

The arrangement of the aforementioned patent is such that only a small amount of exhaust is utilized for ventilating the propeller, with the force of this exhaust being limited by the suction forces. It is believed that the resultant improvement in acceleration is relatively minimal.

It is an object of the present invention to maximize the ventilating effect of the engine exhaust on a propeller designed for surface running and thereby maximize bringing the engine RPM up to speed. It is a further object of the invention to provide an engine exhaust arrangement which materially assists in enhancing engine acceleration with a given size propeller area.

In accordance with the various aspects of the invention, a marine propulsion device includes a drive housing to which is attached a suitable engine, the exhaust of which is pumped downwardly through a suitable passage in the drive housing to adjacent a torpedo housing carrying at least one propeller designed for surface running. A generally horizontal antiventilation plate is disposed above the torpedo housing, and a strut extends between the plate and the torpedo housing, just forwardly of the upper portion of the propeller.

Broadly, substantially all of the engine exhaust is forced by the engine from the drive housing passage for discharge into the path of the upper portion of the propeller. In one embodiment, substantially all of the exhaust passes through the strut and is discharged rearwardly therefrom into ventilating engagement with the forward face of the propeller. In another embodiment, a portion of the exhaust is also discharged downwardly through the antiventilation plate onto the upper edge portion of the propeller.

BRIEF DESCRIPTION OF THE DRAWINGS

The accompanying drawings illustrate the best mode presently contemplated by the inventor for carrying out the invention.

In the drawings:

FIG. 1 is a schematic side elevational view of a marine propulsion device which incorporates the various aspects of the invention;

FIG. 2 is an enlarged fragmentary vertical generally sectional view of the lower aft portion of the device;

FIG. 3 is a vertical section taken on line 3—3 of FIG. 2;

FIG. 4 is a horizontal section taken on line 4—4 of FIG. 2;

FIG. 5 is a view generally similar to FIG. 2, and illustrating a second embodiment; and FIG. 6 is a vertical section taken on line 6—6 of FIG. 5.

DESCRIPTION OF THE PREFERRED EMBODIMENTS

As best shown in FIG. 1 of the drawings, and in the present embodiment, the various aspects of the invention are utilized in a marine stern drive unit 1 adapted to be suitably mounted to the transom 2 of a boat 3. An internal combustion engine 4 is disposed within the boat and includes an output with a shaft 5 which extends through transom 2 to unit 1, in the usual manner.

Although a stern drive unit is illustrated herein, the aspects of the invention could be applied to other marine drive devices, such as outboard motors, without departing from the spirit of the invention.

Unit 1 generally includes a generally vertically extending gear case or drive housing 6 having a generally horizontally fore-to-aft extending torpedo housing 7 disposed adjacent its lower end. Furthermore, a generally planar horizontal finned antiventilation plate 8 is suitably mounted to and extends outwardly from the sides of drive housing 6, and is spaced above torpedo housing 7. In the embodiment shown, a pair of coaxially mounted surfacing propellers 9 and 10 are mounted for rotation generally aft of housing 6. For purposes of driving propellers 9 and 10, a pinion 11 is disposed on the outer end of shaft 5 and meshes with a gear 12 mounted to the upper end of a vertical main drive shaft 13 within drive housing 6. Main drive shaft 13 extends downwardly through housing 6, and is provided with a pinion 14 on its lower end. Pinion 14 meshes with a forwardly disposed rearwardly facing driving gear 15 mounted for rotation about a horizontal drive axis 16. Gear 15 is splined or otherwise mounted on and for rotation with a central axial longitudinally extending first propeller shaft 17. (See FIGS. 2 and 3) Furthermore, pinion 14 meshes with a rearwardly disposed forwardly facing driving gear 18 which is also mounted for rotation about drive axis 16. Gear 18 forms the forward end portion of a longitudinally extending second propeller shaft 19 which is generally tubular and concentric with shaft 17.

Rear propeller 9 is mounted to the rearward end of central first propeller shaft 17, while front propeller 10 is mounted to the rearward end of second propeller shaft 19, in the usual well-known manner, and with the aft end of torpedo housing 7 being closed. The result in this instance is to provide contra-rotating propellers.

A substantially closed-walled main exhaust passage 20, only the lower portion of which is shown in FIG. 2, is connected at its upper end to engine 4 in the usual manner, and extends downwardly through drive housing 6 where it ends at a lower passage discharge portion.

Broadly in accordance with the various aspects of the invention, substantially all of the engine exhaust is pumpingly forced from passage 20 and into the path of the upper portion of forward propeller 10.

For this purpose, and in the embodiment of FIGS. 2–4, main exhaust passage 20 communicates with a central opening 21 in antiventilation plate 8. In addition, a vertically oriented strut 22 is integrally formed with drive housing 6 and extends between antiventilation plate 8 and torpedo housing 7. Strut 22 is generally planar and hollow, forming an internal chamber 23. The strut is furthermore closed at its forward end, and is open along its rear end, to form a slot-like discharge opening 24 communicating with chamber 23. Opening 24 opens up the entire rear portion of strut 22 and extends from approximately the base of the propeller blades to slightly beyond their tips at the top, and faces directly rearwardly toward propeller 10. The upper end portion of strut 22 is also open, as at 25, so that chamber 23 is disposed in communication with plate opening 21. As best seen in FIG. 2, the rearward portion 26 of plate opening 21 terminates above the forward portion of propeller 10. With the construction described, slot-like opening 24 provides essentially the sole discharge for substantially all of the engine exhaust gases, with the discharged gases being dumped forwardly of propellers 9 and 10 and directed rearwardly toward them for purposes of and cavitation control.

If desired, lateral braces 27 may extend between the walls of strut 22 within chamber 23 to maintain structural rigidity.

In the embodiment of FIGS. 5 and 6, the essentially total engine exhaust is directed, not only rearwardly toward propeller 10, as shown by arrows 28, but also downwardly towards its blade tip portions 29. For this purpose, the rearward edge 30 of opening 21 in plate 8 terminates generally above tips 29, rather than above the forward propeller portion, and a remaining portion of the combined exhaust flow is forced downwardly, as shown by arrow 31.

The aspects of the invention are contemplated as being directed to a surfacing type drive wherein the propellers are designed for surface running. That is, from about $\frac{1}{3}$ to $\frac{1}{2}$ of the propeller diameter is in the water during normal running operations, which eliminates the torpedo drag.

Under some operating conditions, it may be desirable to utilize the aspects of the invention with a pair of single drive units tied together through the steering mechanism, each having a single propeller. While the invention will work in such an environment, it should be understood that the dual coaxial propellers provide a larger disk area for the single exhaust to work against. This results in a larger portion of the exhaust being used to impinge the blade surfaces and remove the water from the blade area. Dual contra-rotating propellers of equal diameter and basically similar contour provide a total exhaust impingement area of about 1.4 times the area of a single similar propeller. The exhaust impinges against the entire forward portion of the disk of forward propeller 10, and then is forced rearwardly, where it impinges on the forward portion of propeller 9, thus providing more effective ventilation.

The aspects of the invention, including the essentially total exhaust discharge means, maximize the ability to bring the engine up to speed, even in the face of large surfacing propeller area relative to engine horsepower.

Various modes of carrying out the invention are contemplated as being within the scope of the following claims which particularly point out and distinctly claim the subject matter of the invention.

I claim:

1. In a marine propulsion device, the combination comprising:

(a) a generally vertically extending drive housing (6) connected to a marine engine (4) and adapted to extend downwardly into the water, (b) a generally horizontal fore-to-aft extending torpedo housing (7) disposed at the lower end portion of said drive housing, (c) propeller means designed for surface running and being mounted aft of said torpedo housing and drivingly connected through the latter and said drive housing to said engine, (d) a substantially closed-walled generally vertical engine exhaust passage (20) disposed in said drive housing and connected to said engine, said exhaust passage having a discharge portion at the lower passage end, (e) and essentially total exhaust discharge means (21,22) communicating with said exhaust passage discharge portion and disposed forwardly of said propeller means for discharging substantially all of the engine exhaust into the path of said propeller means to enhance performance of the latter.

2. The combination of claim 1 in which said essentially total exhaust discharge means discharges substantially all of said engine exhaust generally horizontally rearwardly toward said propeller means.

3. The combination of claim 1 in which said essentially total exhaust discharge means:

(a) discharges a first exhaust portion (28) horizontally rearwardly toward said propeller means, (b) and discharges a second exhaust portion (31) generally downwardly onto said propeller means.

4. The combination of claim 1 in which said essentially total exhaust discharge means discharges a portion (31) of said exhaust downwardly onto said propeller means.

5. The combination of claim 1:

(a) which includes a generally horizontal antiventilation plate (8) disposed on said drive housing (6) above said torpedo housing (7), (b) and in which said essentially total exhaust discharge means comprises:

(1) a strut (22) disposed between said antiventilation plate and said torpedo housing, (2) said strut having a chamber (23) communicating with said exhaust passage (20), (3) and a discharge opening (24) in said strut for discharging engine exhaust from said chamber toward said propeller means.

6. The combination of claim 5:

(a) which includes an opening (21) in said antiventilation plate (8), and with said last-named opening communicating between said exhaust passage discharge portion and said strut chamber (23), (b) and the rearward portion (26) of said last-named opening (21) terminates above the forward portion of said propeller means, (c) the construction being such that said discharge opening (24) discharges substantially all of said engine exhaust horizontally rearwardly toward said propeller means.

7. The combination of claim 5:

(a) which includes an opening (21) in said antiventilation plate (8), and with said last-named opening communicating between said exhaust passage discharge portion and said strut chamber (23), (b) and the rearward portion (31) of said last-named opening (21) terminates above the blade tip portions (29) formed by said propeller means, (c) the construction being such that:

(1) a first exhaust portion (28) is discharged from said discharge opening (24) and horizontally rearwardly toward said propeller means, (2) and a second exhaust portion (31) is discharged through said antiventilation plate and generally downwardly onto said blade tip portions (29).

8. The combination of claim 1, 2, 3, 4, 5, 6 or 7 in which:

(a) said propeller means comprises a pair of coaxially mounted forward (10) and rearward (9) contra-rotating surfacing propellers, (b) the construction being such that said essentially total exhaust discharge means (21,22) causes exhaust to impinge on the entire forward portion of said forward propeller, and with a portion of the exhaust being forced rearwardly between the blades of said forward propeller for impingement on the forward portion of said rearward propeller.

* * * * *